United States Patent [19]

Johnson

[11] 3,972,644

[45] Aug. 3, 1976

[54] VANE CONTROL ARRANGEMENT FOR VARIABLE AREA TURBINE NOZZLE

[75] Inventor: Roger W. Johnson, Chillicothe, Ill. Ill.

[73] Assignee: Caterpillar Tractor Co., Peoria, Ill.

[22] Filed: Jan. 27, 1975

[21] Appl. No.: 544,161

[52] U.S. Cl. ..... 415/163; 415/151

[51] Int. Cl.[2] ..... F01D 17/12; F01D 17/16

[58] Field of Search ..... 415/161, 162, 163, 164, 415/165, 151

[56] References Cited

UNITED STATES PATENTS

| | | | |
|---|---|---|---|
| 488,056 | 12/1892 | Bookwalter | 415/161 |
| 2,350,839 | 6/1944 | Szydlowski | 415/164 |
| 2,382,913 | 8/1945 | Robinson | 415/161 |
| 3,033,519 | 5/1962 | Radtke | 415/164 |
| 3,231,239 | 1/1966 | Tyler | 415/163 |
| 3,588,270 | 6/1971 | Boeles | 415/163 |

*Primary Examiner*—Henry F. Raduazo
*Attorney, Agent, or Firm*—Phillips, Moore, Weissenberger, Lempio & Strabala

[57] ABSTRACT

A turbine having a radial inlet to the turbine wheel is provided with variable nozzle vanes to control the inlet flow to the turbine. The vanes are controlled by lever-actuated gearing to provide a positive coupling of input to the vanes.

5 Claims, 3 Drawing Figures

VANE CONTROL ARRANGEMENT FOR VARIABLE AREA TURBINE NOZZLE

BACKGROUND OF THE INVENTION

The present invention relates to turbines and pertains particularly to variable-area turbine nozzles.

Turbochargers for improving the performance of internal combustion engines are well known. One difficulty with such turbocharged engines, however, is that the engines normally are required to perform at different speeds and the turbocharger is often most effective at a specified constant speed. The turbocharger, therefore, does not normally operate efficiently at the various speeds of the engine.

One approach to the problem of providing more precise control of a turbine has been to provide variable-area nozzles at the inlet of the turbine wheel. These variable nozzles normally employ variable vanes to vary the inlet area of the nozzle to thereby control the gases to the turbine wheel.

Various mechanisms have been provided for control of variable nozzles. However, many of these present difficulties in operation. Many of the prior art devices employ cams and levers which sometimes prevent precise and proper control as well as positive control of the nozzle. Gearing has also been employed for such control; however, the gearing arrangements provided are often inefficient and lack positive and precise control.

The prior art is exemplified by the following U.S. Pat. Nos.: 3,025,036 issued Mar. 13, 1962; 2,029,067 issued Apr. 10, 1962; 3,243,159 issued Mar. 29, 1966; and 3,816,021 issued June 11, 1974.

These prior art systems have failed to provide control means for a turbocharger for making the turbocharger output correspond with engine demands.

SUMMARY AND OBJECTS OF THE INVENTION

It is a primary object of the present invention to provide control means for a turbine that overcomes the above problems of the prior art.

Another object of the present invention is to provide improved control means for a turbine of a turbocharger.

A further object of the present invention is to provide improved control means for a turbocharger that is operative to control turbocharger output to engine demands.

In accordance with the primary aspect of the present invention the turbine of a turbocharger is provided with variable nozzle inlet means, including an annular gear and a sector gear to provide a positive coupling of an inlet control with a variable-area nozzle means.

BRIEF DESCRIPTION OF THE DRAWINGS

The above and other objects of the present invention will become apparent from the following description when read in conjunction with the drawings wherein.

DETAILED DESCRIPTION OF A PREFERRED EMBODIMENT

Figure 1:
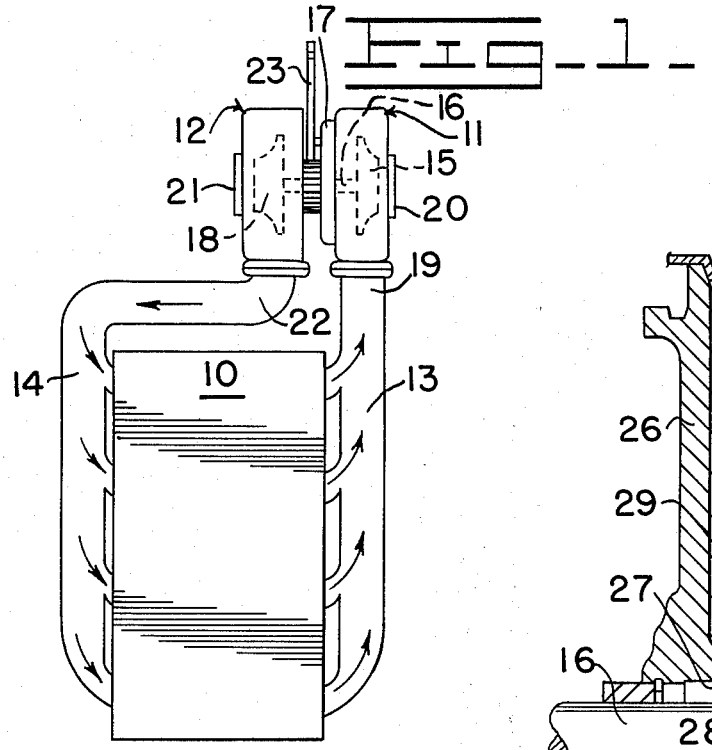
FIG. 1 is a schematic layout of an engine employing a turbine embodying the present invention.

Referring particularly to FIG. 1 of the drawings, there is illustrated a schematic layout of an internal combustion engine 10 having a turbocharger comprising a turbine indicated generally at 11 and a compressor indicated generally at 12 connected to the exhaust manifold 13 and intake manifold 14 respectively. The turbocharger operates in a conventional manner, taking exhaust gases by way of manifold 13 through turbine 11, which operates the compressor 12 for compressing and supplying intake gases to the intake manifold 14. The turbocharger includes a turbine wheel 15 which is mounted on a shaft 16, which shaft is rotatably mounted within a central housing 17. The shaft 16 extends into the housing of the compressor wherein an impeller 18 is mounted on the end of the shaft. Exhaust gases from manifold 13 enter by way of inlet 19 into the turbine 11 where they engage and cause rotation of turbine wheel 15 before being expelled from an exhaust outlet 20.

The compressor 12 draws a charge of air into the compressor by way of an inlet 21 compressing the air and expelling it by way of an outlet 22 into the intake manifold 14 of the engine 10.

The turbocharger includes control means, to be described below, which is operative to control nozzle opening into the turbine for controlling the speed of the turbine. The control means includes a lever 23 which is connected to suitable control means on the vehicle, such as accelerator or governor linkage, for coordinating the turbine control in response to demands of the engine.

Figure 2:
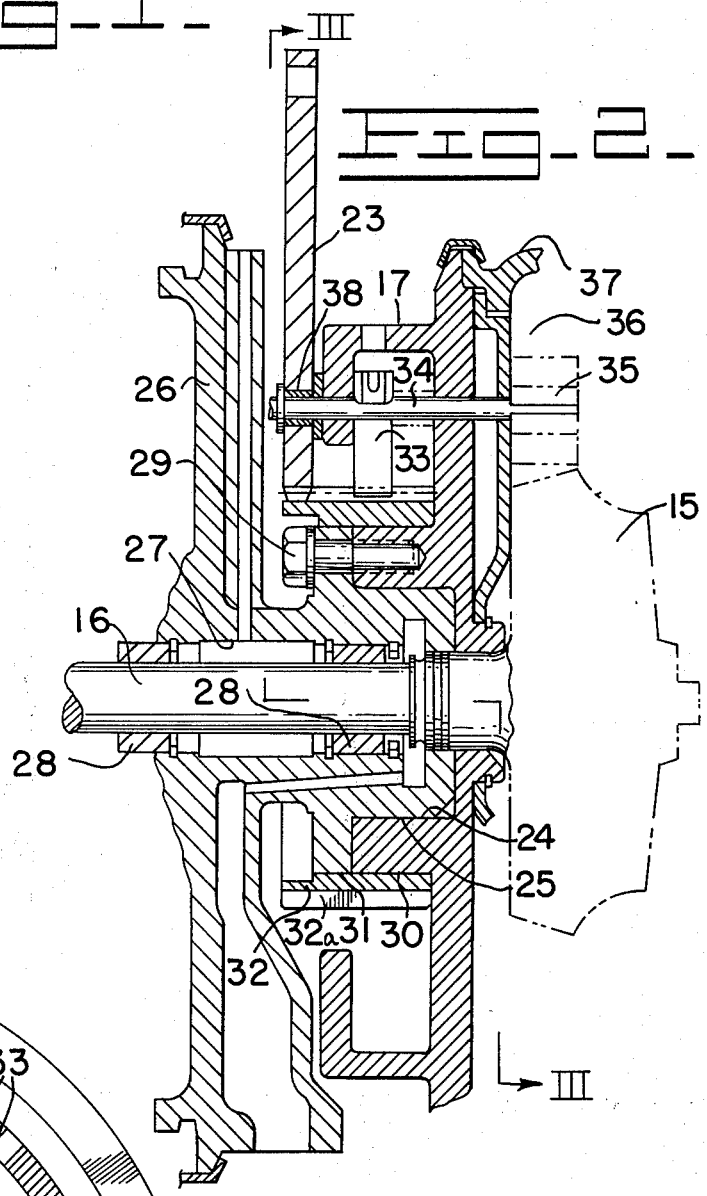
FIG. 2 is a partial elevational view in section of the turbine of FIG. 1 illustrating a preferred embodiment of the present invention.

Turning now to FIG. 2, the control system of the present invention is most clearly illustrated. The central housing 17 includes a cylindrical pilot bore 24 which receives the outer end 25 of a hub portion of an adapter housing 26 in which the shaft 16 is rotatably mounted. The adapter housing 26 includes a bore 27 in which the shaft 16 is rotatably mounted by suitable bearing means 28. The housings 17 and 26 are secured together by suitable bolts 29 and include means respectively defining outer cylindrical surfaces 30 and 31, which define journal means for rotatably supporting an annular gear 32.

The annular gear 32 comprises a portion of the control means for controlling the nozzle and includes a plurality of outwardly extending teeth 32a for engaging a plurality of segment or sector gears 33. The segment or sector gears 33 are mounted on shafts 34 which are mounted in suitable bores in housing 17. A vane 35 is mounted on the outer end of each of the shafts 34 and is positioned within a radial inlet 36 defined by the turbine housing 37. The inlet 36 essentially defines an annular passageway through which exhaust gases are fed radially inward toward the turbine wheel 15. The vanes 35 are disposed within the passage 36 and control the passage of gas therethrough as will best be seen in FIG. 3.

The lever 23 is pivotally mounted in a suitable manner such as by means of bearings 38 on one of the shafts 34 and includes at its inward end a sector or segment gear 23a for engaging and imparting at least limited rotary motion to the annular gear 32.

Figure 3:
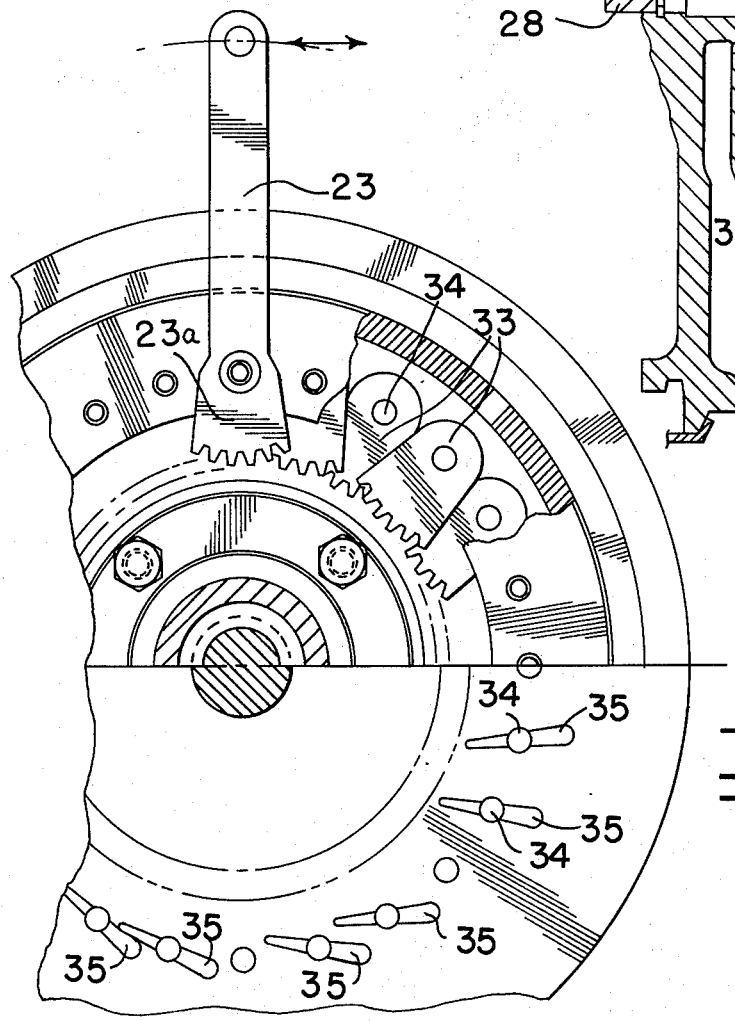
FIG. 3 is a view taken generally along lines III—III of FIG. 2.

Turning to FIG. 3, it will be seen that the plurality of segments 33 are alternately staggered or placed in adjacent parallel planes along a common circle extending around the periphery of the annular gear 32. This permits the segments as well as the vanes to be closely positioned circumferentially around and at a common radial distance from the axis of the turbine wheel.

As best seen in FIG. 3, the vanes 35 may be pivoted on their respective shafts 34 at various angles between a fully open position and a substantially closed position. These vanes are shown in pairs in FIG. 3 at various settings to illustrate the degree of adjustment thereof.

The gear drive arrangement of the present control system provides a positive and direct coupling of the input from control lever 23 to the vanes 35 for direct and positive control and adjustment of the vanes.

While the present invention has been described by means of a single embodiment, it is to be understood that numerous changes and modification may be made therein without departing from the spirit and scope of the invention as defined in the appended claims.

What is claimed is:

1. A turbine including a turbine housing having a turbine wheel rotatably mounted therein and inlet means for directing gas radially inward toward said wheel, and control means comprising:

a plurality of vanes pivotally mounted in said inlet means on a common circle about the periphery of said turbine wheel for controlling the flow of gas through said inlet; and, control means for adjusting said vanes in said inlet, said control means comprising a gear segment connected to each of said vanes and a central annular gear rotatably mounted co-axially of said turbine meshing with each of said gear segments, and a lever including a gear segment on one end thereof in meshing engagement with said central gear for moving said central gear for simultaneous adjustment of said vanes, wherein said gear segments are alternately positioned in first and second planes about said central gear and at a common radial distance from the axis of the turbine.

2. The turbine of claim 1 comprising a compressor mounted in a compressor housing co-axially of said turbine:

a drive shaft connecting said turbine to said compressor; and a control housing disposed between said turbine housing and said compressor housing for mounting said control means.

3. The turbine of claim 2 wherein said annular gear is mounted within said control housing on a cylindrical portion thereof.

4. The turbine of claim 3 comprising a shaft connecting each of said gear segments to one of said vanes.

5. The turbine of claim 3 wherein said gear segments are mounted in said control housing and connected to said vanes by means of a plurality of shafts extending parallel to said drive shaft.

* * * * *